US006478171B2

(12) United States Patent
Freeman

(10) Patent No.: US 6,478,171 B2
(45) Date of Patent: Nov. 12, 2002

(54) VINYL LIFTING CRANE AND METHOD

(76) Inventor: Glen Dale Freeman, 3627 Beech Way, Van Buren, AR (US) 72956

( * ) Notice: Subject to any disclaimer, the term of this patent is extended or adjusted under 35 U.S.C. 154(b) by 54 days.

(21) Appl. No.: 09/741,947

(22) Filed: Dec. 20, 2000

(65) Prior Publication Data

US 2001/0050263 A1 Dec. 13, 2001

Related U.S. Application Data

(60) Provisional application No. 60/173,091, filed on Dec. 27, 1999.

(51) Int. Cl.[7] ..... B66C 23/18
(52) U.S. Cl. ..... 212/179
(58) Field of Search ..... 212/179, 319; 254/334

(56) References Cited

U.S. PATENT DOCUMENTS

| | | | | | |
|---|---|---|---|---|---|
| 3,244,293 | A | | 4/1966 | Stahmer | |
| 3,452,964 | A | | 7/1969 | Bibeault | |
| 4,372,452 | A | | 2/1983 | McCord | |
| 4,491,301 | A | | 1/1985 | Pendola | |
| 4,560,074 | A | * | 12/1985 | Manning | 212/179 |
| 4,570,543 | A | | 2/1986 | Ishikura et al. | |
| 4,684,031 | A | * | 8/1987 | Bergman et al. | 212/179 |
| 4,782,962 | A | | 11/1988 | Hackworth et al. | |
| 4,944,056 | A | * | 7/1990 | Schroeder et al. | 5/81 R |
| 5,018,603 | A | | 5/1991 | Ito | |
| 5,042,208 | A | | 8/1991 | Richardson | |
| 5,072,962 | A | | 12/1991 | Webb | |
| 5,090,666 | A | | 2/1992 | May | |
| 5,158,188 | A | * | 10/1992 | Nordberg | 212/209 |
| 5,263,687 | A | * | 11/1993 | Garbiso | 254/334 |
| 5,316,265 | A | * | 5/1994 | Welch et al. | 212/179 X |
| 5,445,281 | A | * | 8/1995 | Hung | 212/179 |
| 5,690,240 | A | | 11/1997 | Thiermann, Sr. | |
| 5,901,864 | A | | 5/1999 | Morrow | |
| 5,927,440 | A | | 7/1999 | Freeman | |
| 6,105,727 | A | | 8/2000 | Nakao | |
| 6,135,300 | A | * | 10/2000 | Fox | 212/179 |
| 6,230,844 | B1 | | 5/2001 | Latorre | |

* cited by examiner

*Primary Examiner*—Steven A. Bratlie

(57) ABSTRACT

A portable vinyl lifting crane with a nip roller drive system that feeds a preferred flat rope between the rollers for traction to achieve two primary functions. One function enables the hoist to climb itself up to a structure by securing one end of a preferably flat rope to a support beam, for example, and allowing the rope to hang in a vertical manner. The crane is attached to a free end of the flat rope and a radio control may command the nip rollers to feed the rope between the rollers, enabling the hoist to climb the rope. Once the crane has climbed the rope, it is releasably attached to the structure. The second function feeds a preferred flat rope through the nip drive system and enables lifting, including lifting with an applied counter weight.

20 Claims, 9 Drawing Sheets

VINYL LIFTING CRANE AND METHOD

CROSS-REFERENCE TO RELATED APPLICATIONS

Priority is claimed to provisional application serial number 60/173,091 which was filed Dec. 27, 1999.

BACKGROUND OF THE INVENTION

The present invention is directed to a portable or mobile jib crane with components thereof, and or units, assemblies, or subsystems thereof. More particularly, the present invention concerns an improved hoist, lift or materials handling jib crane with components, assemblies, units or subsystems, especially adapted for use in connection with billboard signs, marquees, displays, and the like.

In the billboard industry the use for vinyl faces to create images on is a growing trend. The installing of the vinyl faces requires manual lifting by way of block and tackle, or a boom truck may be used to lift or lower the vinyl faces. Prior art does not address an efficient or practical method for elevating or lowering the vinyl faces.

Webb (U.S. Pat. No. 5,072,962) discloses a portable load bearing winch which is releasably attached to a front or back of a vehicle hitch using a female square tubing member and a square male end for attachment to the vehicle.

Morrow (U.S. Pat. No. 5,901,864) discloses a kingpost type luffing crane which can be removed from a receiving socket for relocation purposes.

Thiermann, Sr. (U.S. Pat. No. 5,690,240) discloses a portable crane assembly which can be coupled to and decoupled from a transport dolly.

Richardson (U.S. Pat. No. 5,042,208) discloses a detachable concrete wall finishing machine which is capable of lifting a finishing head and able to transport the finishing head in a horizontal fashion along a concrete wall.

Hence, there is a need for a portable/mobile jib crane for the billboard industry. The industry may become less reliant to physically lifting vinyl faces up to the billboards, or using heavy lift trucks which may be a burden for hard to access places and the expense of running them.

BRIEF SUMMARY OF THE INVENTION

In accordance with the present invention, a vinyl lifting crane is provided which addresses the drawbacks of prior art and which is relatively simple in construction, easy to operate and maintain. In accordance with one embodiment of the present invention, the vinyl lifting crane is especially adapted for use in connection with billboard signs and the like, more particularly for lifting and lowering two objects of the approximate same weight simultaneously, better known as counter weighting. In the billboard industry the practice of creating images on a vinyl surface is commonplace in the industry, the vinyl lifting crane will aid in the lifting of a vinyl face which is to be installed, and the lowering of the uninstalled vinyl simultaneously, creating a counter weighting effect.

The vinyl lifting crane will possess two primary functions in order to successfully aid in installing vinyl faces. The vinyl lifter will be capable of climbing itself up to a billboard structure, or jib, for example, then once atop a billboard, can change function to serve as a hoist. This hoist is releasably attached to a billboard structure via male and female square tubing mating members making it mobile for the multiple locations it will need to be used.

The vinyl lifter has a battery powered motor which drives a nip roller, and in conjunction with the drive roller is a plurality of idler rollers. When a flat rope is threaded through these rollers traction of the rope occurs. This flat rope when attached atop a billboard will hang down or can be attached to an anchor point on the ground. The vinyl lifter will climb or descend the flat strap by method of traction from the nip rollers. Once the vinyl lifter is installed, it may be commanded by an infra red remote unit to drive the nip rollers which in turn will cause the flat rope to move in a direction desired to lift one vinyl from the ground to atop the billboard while in turn lowering the uninstalled vinyl face to its destination on the ground, then the lowered vinyl may be loaded into a pick-up truck, for example. The vinyl installer will save money, time and be much more efficient than the presently employed methods.

One employed method is physically lifting the vinyls by way of block and tackle. Another employed method entails the use of boom trucks which may be expensive to operate and may not be able to get to hard access places. The method of installing the vinyl with a boom truck includes the boom lifting a vinyl up to a billboard sign, attaching one end of the vinyl to the billboard then as the boom swings left to right will unroll the vinyl.

The present vinyl installer will possess horizontal movement by means of a trolley which has a female square tubing member to receive the male square tubing member of the vinyl installer. The vinyl lifter will unroll a vinyl face by manually pushing the trolley along a rail which is located in the back of the billboard sign. The mentioned drawbacks related to the employed methods of installing vinyl faces are apparent and warrant the introduction of a mobile or transportable, self climbing jib crane.

The principle object of the present invention is the provision of a hoist and method involving a hoist which is relatively simple in construction, easy to install, easy to operate, and easy to maintain.

Another object of the present invention is the provision of an improved mobile hoist and method including a transportable jib crane with its attached drive components.

A further object of the present invention is the provision of a self contained, battery powered motor drive system for a jib crane.

Another object of the present invention is the provision of a self-contained, self propelled, transportable mobile jib crane.

Other objects and further scope of the applicability of the present invention will become apparent from the detailed description to follow, taken in conjunction with its accompanying drawings wherein like parts are designated by like reference numerals.

DETAILED DESCRIPTION OF THE INVENTION

In accordance with one embodiment of the present invention, the vinyl lifting crane includes a portable, mobile aluminum jib crane with an attached nip roller drive system.

The drive will feed a preferred flat rope between the rollers for traction to achieve two primary functions.

One function will enable the hoist to climb itself up to a structure by a person securing one end of a preferably flat rope to a support beam for example, and allowing the rope to hang in a vertical manner. The crane will be attached to free end of flat rope and radio control may be used to command the nip rollers to feed the rope between said rollers, enabling the hoist to climb the rope. This will eliminate the need to carry the hoist when climbing up stairways, ladders, etc. Once the crane has climbed the rope, it is releasable attached to the structure by inserting a male square tubing member into a female square member of the structure, for example. Also the crane can be inserted into a trolley for horizontal travel.

The second function will feed a preferred flat rope through the nip drive system and enable the lifting of vinyl faces, materials, tools, props, etc., up to a billboard structure. Counter weighting can be applied when lifting vinyl faces for billboards because usually one advertisement is being uninstalled, while an updated ad will replace it.

So the need exist to lift the updated ad to the billboard structure, while lowering at the same time the replaced advertisement. The present invention addresses a need in the billboard industry because the hoist will eliminate physically, by block and tackle, lifting the vinyl faces manually up to the billboards. OSHA standards will not allow workers to carry items which may impede climbing the ladders safely, therefore the need for the self climbing hoist is warranted and appreciated which prior art does not address.

Figure 1:
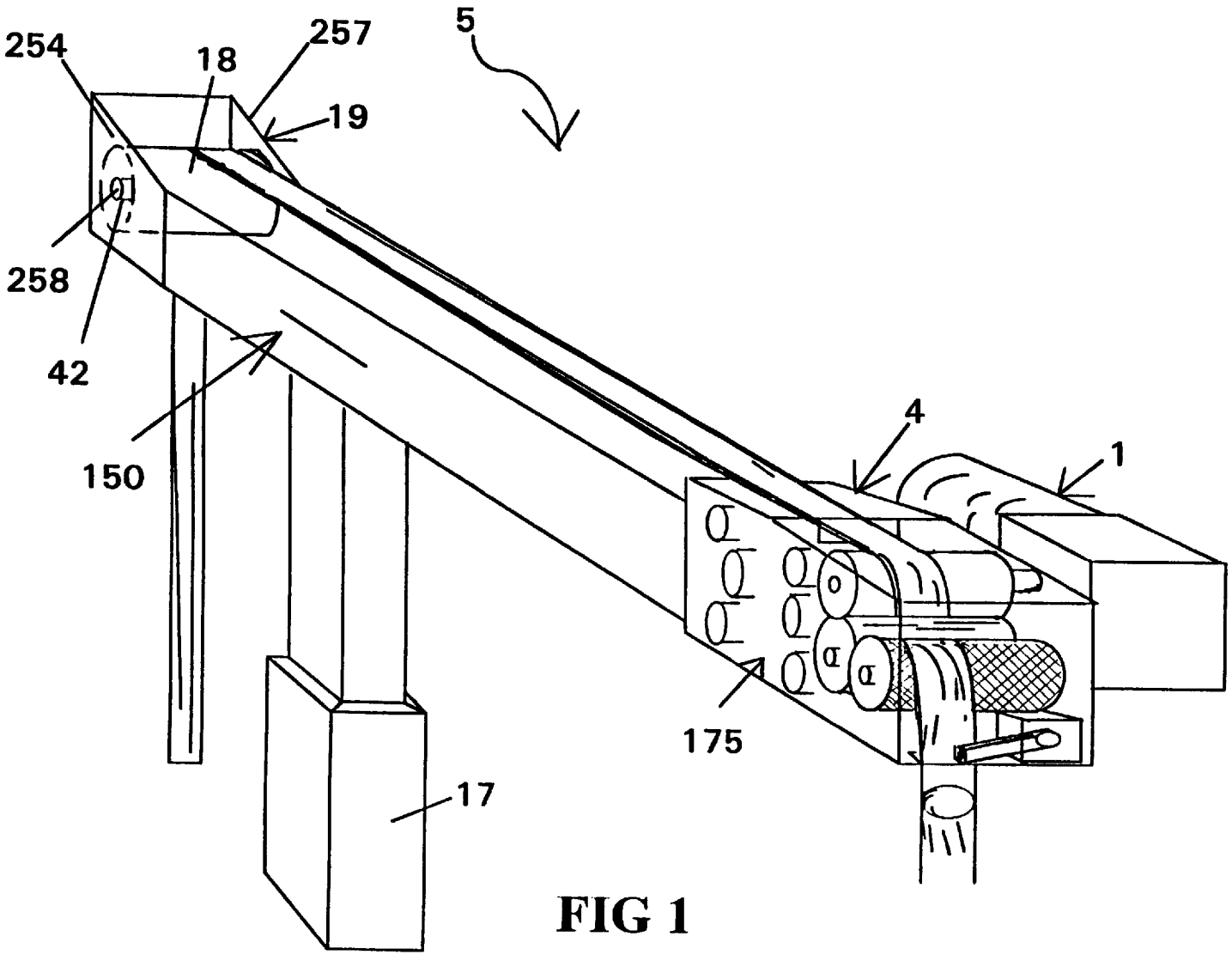
FIG. 1 A perspective view of a vinyl lifting crane.
Figure 2:
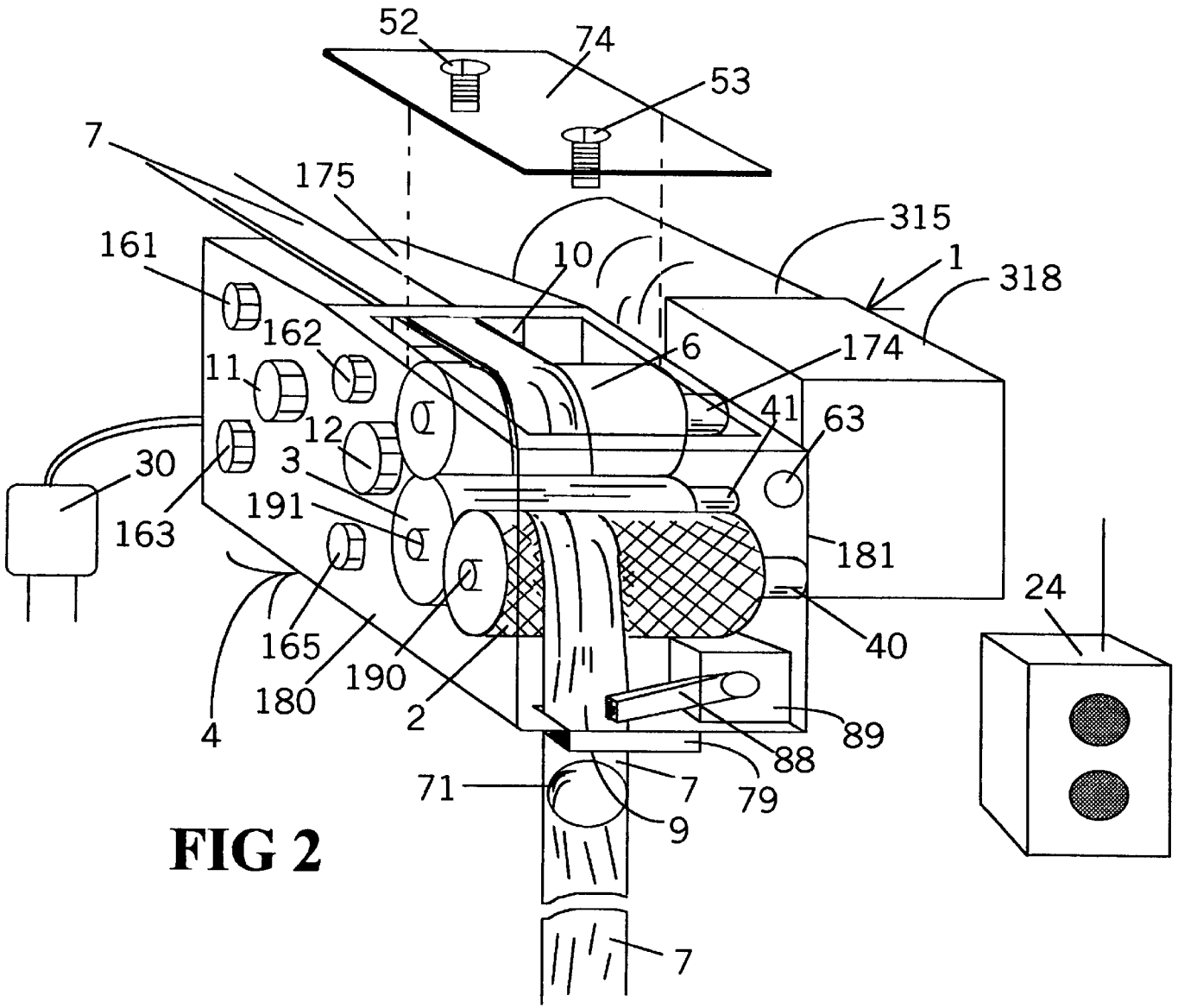
FIG. 2 A perspective view of drive embodiment for a vinyl lifting crane.
Figure 3:
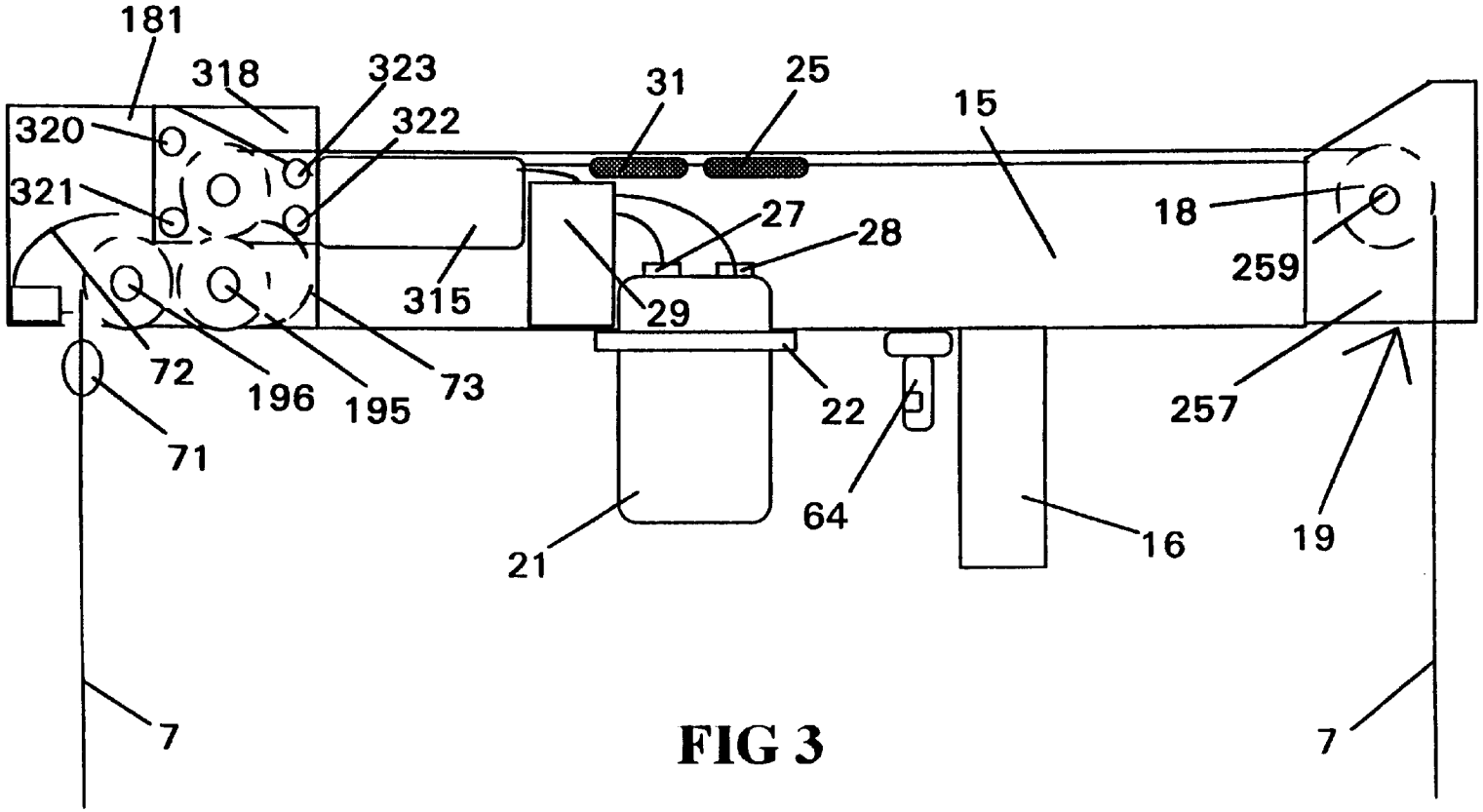
FIG. 3 A side view for a vinyl lifting crane.

In accordance with one embodiment of the present invention, the vinyl lifting crane designated as (5) includes an elongate square tubing member (15) attached to vertical member (16) to form the sub-frame (150)(See FIGS. 1,2 & 3). The drivetrain (1) which includes the drive motor (315) and gearbox reducer (318) will mount to member (175) via bolts (320), (321), (322), and (323). Drive roller (6) will be installed securely onto drive shaft (174) and idler roller (2) will rotate freely around shaft (40) and shaft (40) will extend between plates (180) and (181) will be attached to plates (180) and (181) via bolts (190) and (196). Bolts (190) and (196) will pass through their respective plates (180) and (181) and engage shaft (40) which will have a threaded core to enable tightening of the bolts. Idler roller (3) will rotate freely around shaft (41) and shaft (41) also will extend between plates (180) and (181) and be secured to plates (180) and (181) via bolts (195) and (191). It is conceived that shafts (40) and (41) can be secured with keepers (not shown). This drive system which includes drive motor (315), gearbox reducer (318), mounting member (175), and a plurality of rollers will be designated as drive system (4) which can be releasably attached to member (15) via set screws (11) and (12) or could be attached rigidly by bolts (161), (162), (163), and (165).

On one end of member (15) will be device (19) which will include an idler roller (1 8) which will rotate around shaft (42) and shaft (42) will extend between plates (254) and (257) with bolts (258) and (259) to pass through said plates into the shaft (42) which will have a threaded hollow core to enable tightening of bolts (258) and (259)(See FIG. 1 & 3). Device (19) will serve as a guide roller for flat rope (7).

To provide power to drive motor (315) rechargeable battery (21) will be inserted in to batter holder (22) which will result in the engagement of the battery (21) to contacts (27) and (28) transferring the energy of battery (21) to drive motor (315). The battery (21) can be charged by method of a recharging system from a vehicle to include voltage regulator, alternator or can be charged by plugging receptacle (30) into a 110 v outlet. When receptacle (30) is plugged into an outlet, 110 v is applied to onboard battery charger (29) which will result in providing correct regulated power to battery (21) which may be 12 v, 18 v, or 24 v depending on the voltage requirements of the battery (21) and drive motor (315). The power to drive motor (315) can be actuated via remote control (24) by signaling remote sensor (63), or by using bidirectional switch (64) which will control on and off position, forward and reverse, for example, when pertaining to direction(See FIGS. 2 & 3).

Figure 5:
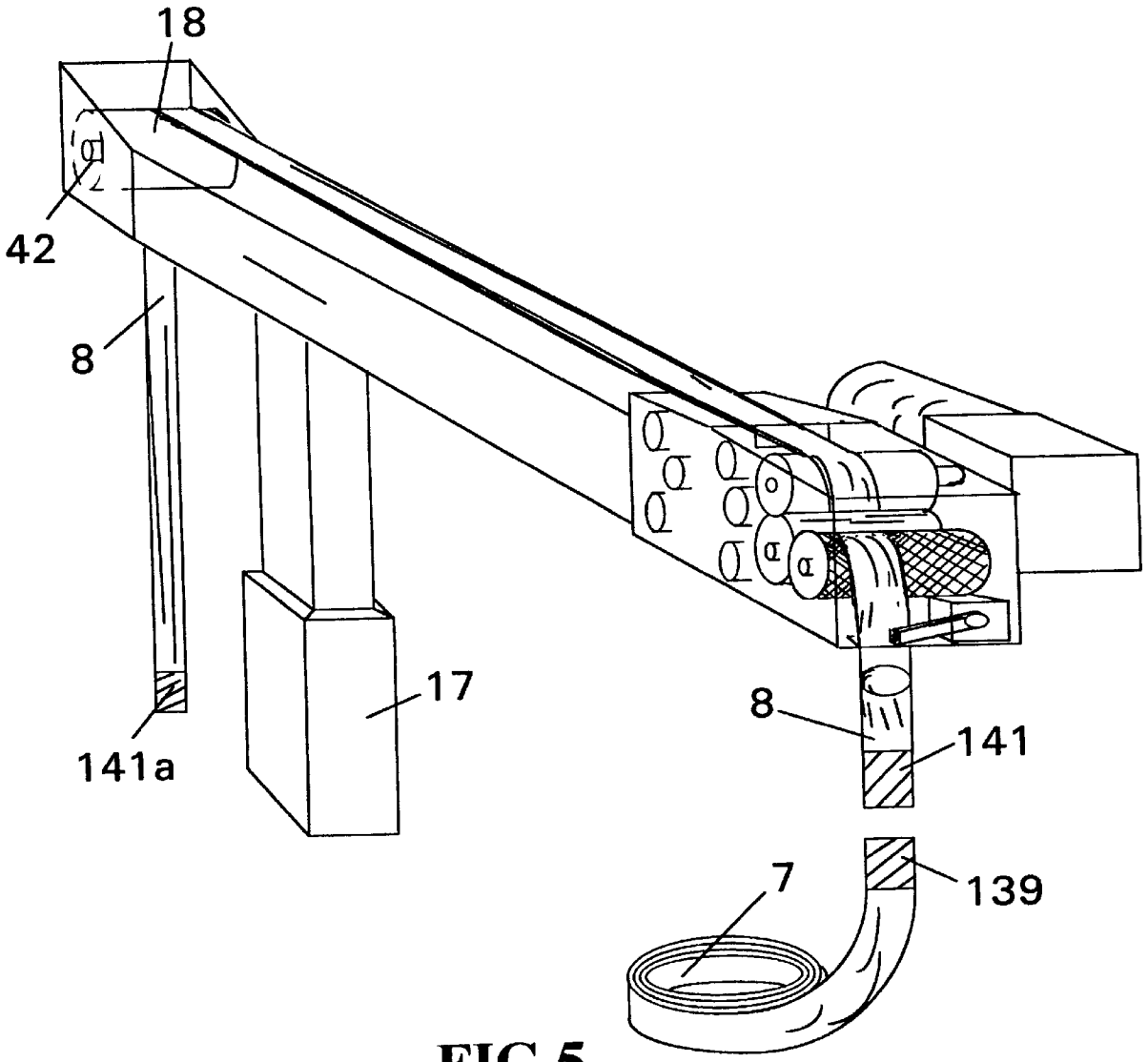
FIG. 5 A perspective view for a vinyl lifting crane, including "VELCRO"material of respective flat rope(s).
Figure 8:
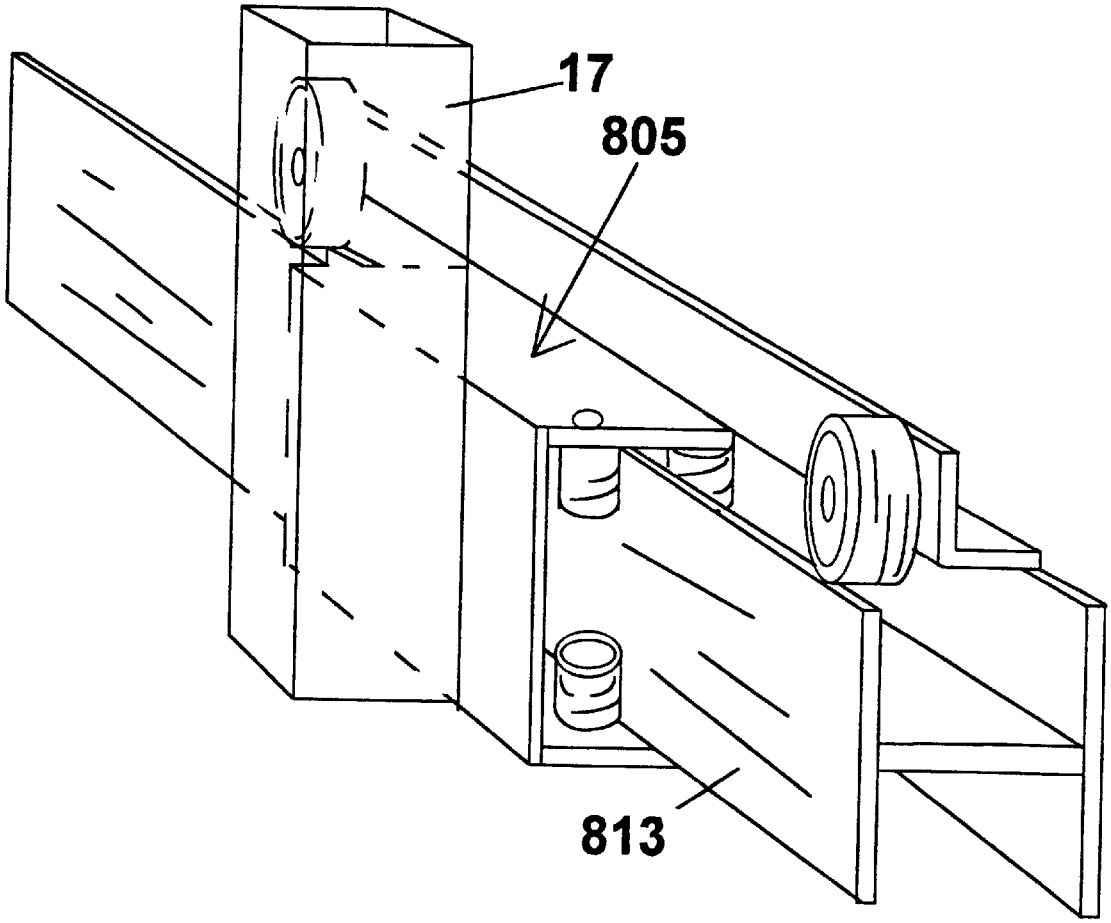
FIG. 8 Trolley with included female member for the receiving of vinyl lifting crane's male supporting member.

When power is supplied to drive motor (315) and rpm is reduced at the gearbox reducer (318) output drive shaft (174), will rotate drive roller (6). When crane (5) is to be used, jog button (25) is pressed and power is supplied to drivetrain (1) causing rotation of drive roller (6) to receive crane rope (8) (See FIG. 8) through access opening (9) (See FIG. 2) of mounting member (175). Guide plates (72) and (73) will aid in the threading of crane rope (8) through rollers (2), (3), and (6) (See FIG. 3). Also to aid in threading of rope (8) is plate (74) which can be detached in needed via removing bolts (52) and (53) to enable access to manually thread rope (8) between rollers (2) and (3) then to capture said rope and manually guide it to exit access opening (10) (See FIGS. 2 & 5).

Rope (8) is to remain threaded into crane (5) and said rope may have "VELCRO"stripe(s) (141) and **(141*a*) on both ends. Rope (7) will also have "VELCRO" stripe (139) and has the purpose of sticking to "VELCRO" (141) of rope (8) (See FIG. 5). When the job button (25) is pushed, this will cause the rotation of drive roller (6) which will result in rope (8) to move in a direction to cause rope (8) to be pulled into access opening (9) and to pass through rollers (2), (3), (6), then to exit drive system (4) through exit access opening (10)**.

Figure 7:
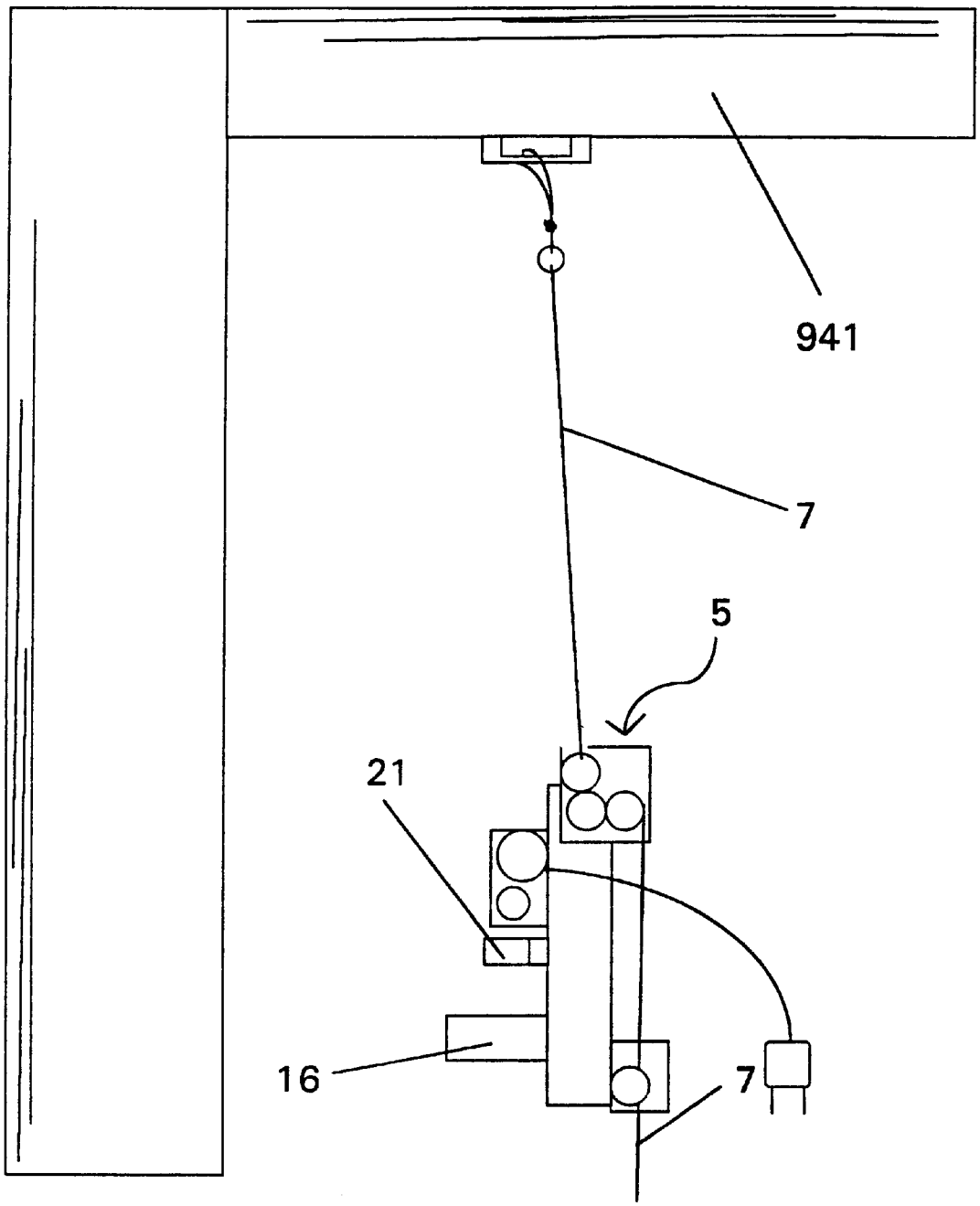
FIG. 7 A side view for a vinyl lifting crane climbing itself up to a structure.

With the flat rope (7) now engaging the rollers (2), (3), and (6) of the crane (5), one end of flat rope (7) is tied to a structure, for example support member (941), elevated atop a billboard sign, the crane (5) may be commanded to actuate drivetrain (1) via remote control device (24) this will result in rollers (2), (3), and (6) to rotate, thus traction occurs with flat rope (7) applied to rollers (2), (3), and (6) of the crane (5) resulting in the rope (7) travel direction pulling into access opening (9). This will result in the crane (5) to climb itself up to the structure via flat rope (7), "TEFLON" stripe (79) will help protect the flat rope (See FIGS. 2 & 7).

Once arrived at the structure, crane (5), if not stopped by the operator will shut off via safety switch (89). When ball

Figure 4:
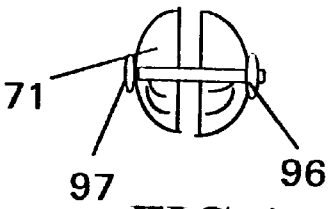
FIG. 4 A side view for a ball device to actuate shut-off limit switch.

(71) strikes switch arm (88)(See FIG. 2), ball (71) can be removed from flat rope, if desired, by detaching nut (96) from threaded screw (97) disassembling ball (71) (See FIG. 4).

Figure 10:
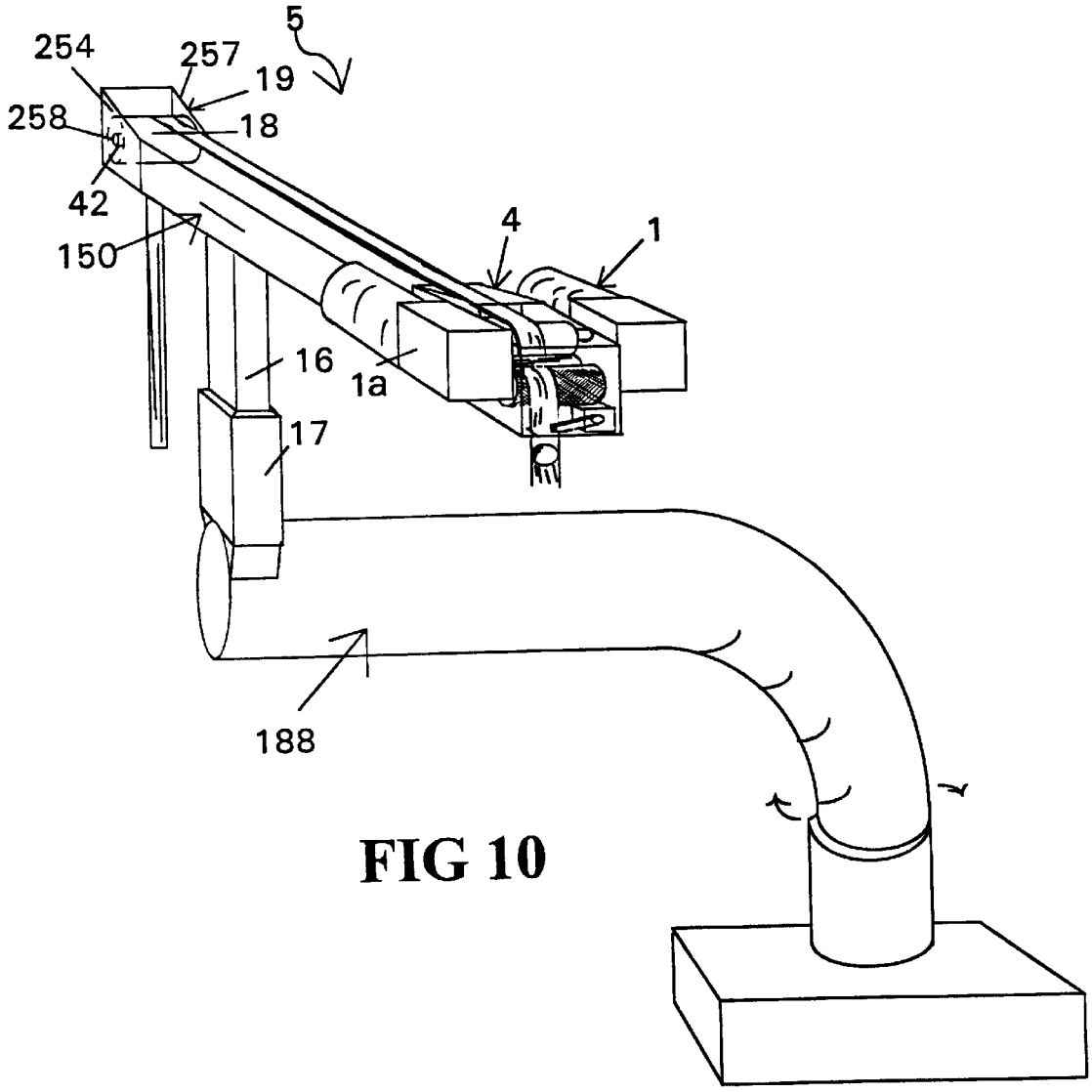
FIG. 10 A perspective view for a vinyl lifting crane installed into a jib.

Crane (5) can now be manually lifted into female square tubing member (17) which may be attached by weldments to trolley (805) (See FIG. 8), jib (188) capable of 360 degrees rotation (See FIG. 10), a boom, a metal support beam, or directly to a desired structure. When crane (5) is properly installed into member (17) said crane can function as a load bearing hoist. After the transportable crane, hoist, or lift is temporarily attached to a billboard structure, the transportable crane is no longer dependent upon the flat strap for support means, therefore, the flat rope, strap, or the like, is released from the support member of the billboard structure, and may function as a hoisting strap for engaging the transportable crane, hoist or lift to carry supplies up or down a billboard sign, for example.

The flat rope (7) which is installed into access opening (9) will engage drive rollers (2), (3), and (6) then to exit from exit access opening (10) to extend the length of member (15) to rest across idler roller (18). This flat rope (7) can now become load bearing preferably by attaching one object on each end of said flat rope (7) to give counter weighting effect (See FIG. 1, load objects not shown). This method may minimize wear and tear for drivetrain (1). Also may reduce wear for a brake which the drive motor (315) may possess. When jog control (31) or (25) is pressed for desired direction (See FIG. 3), power is transferred to drivetrain (1) resulting in the movement of load bearing flat rope (7) for the purpose of lowering one object while another is being raised simultaneously (See FIG. 1, objects not shown). This command can also be achieved by remote control (24) (See FIG. 2).

Figure 6:
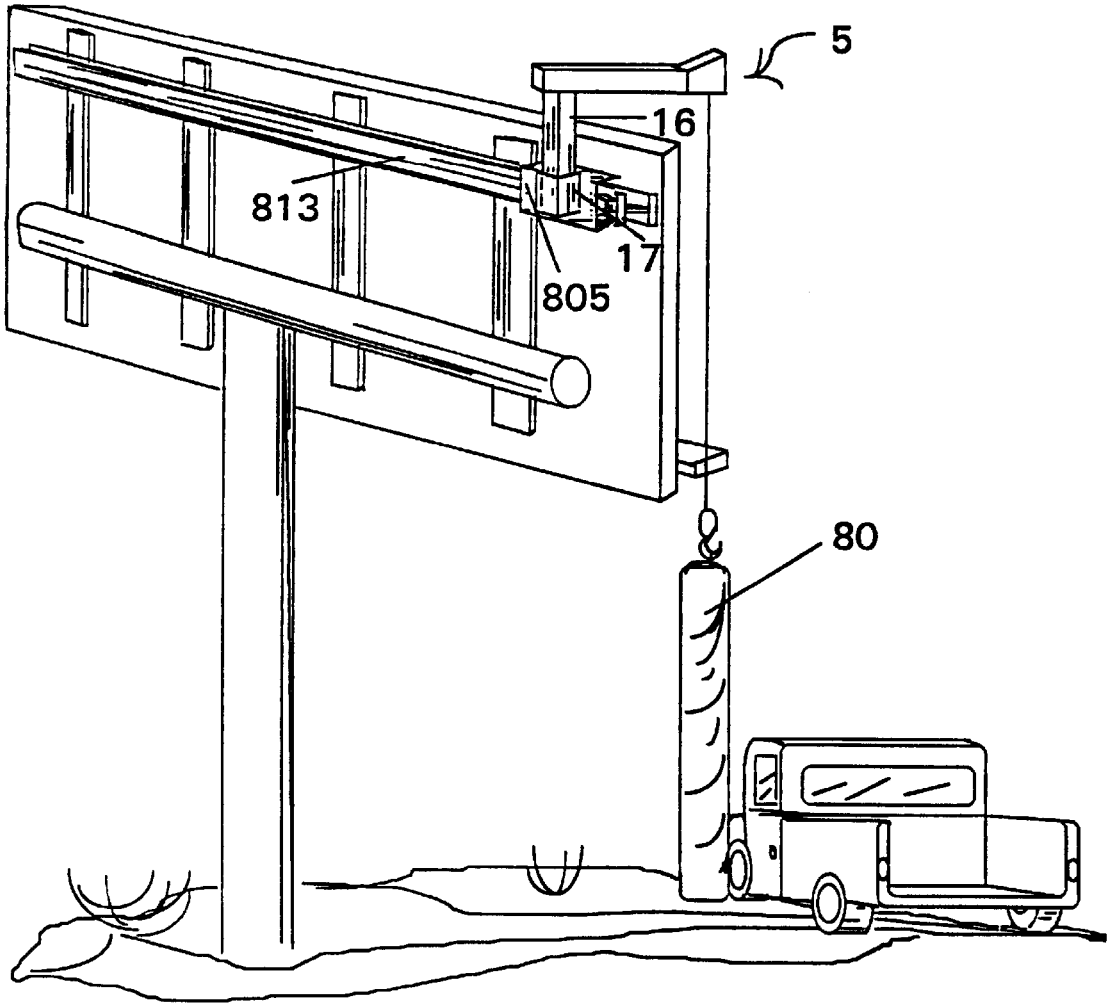
FIG. 6 A perspective view for a vinyl lifting crane engaging a female member of a trolley, and disclosing rail for which a trolley travels horizontally on a billboard structure.

When trolley (805) is utilized, the vinyl (80) will travel horizontally across rail (813) which will give horizontal movement to crane (5). This will allow vinyl (80) to be unrolled by securing it to an end of a billboard then as the trolley (805) travels across rail (813) via manual power, the crane (5) will cause the vinyl (80) to unroll. Trolley (805) should remain on rail (813), (see FIGS. 6 & 8).

It is conceived by those skilled in the art that different configurations for a self climbing crane can be used. For example, a female member may be attached to a structure, or a jib, to receive a corresponding male member from multiple angles, horizontally or from a bottom side of said jib, for example. The female and corresponding male members may be secured by a pin. Also a drum can be used by wrapping a rope around said drum several times, in conjunction with a guide on each end of the drum, when power is supplied to a drivetrain the drum will rotate, this will result in the traction of the rope to enable rope movement, and the guides to keep the rope from straying. The rope may need a grooved surface of the drum for stability.

Figure 9:
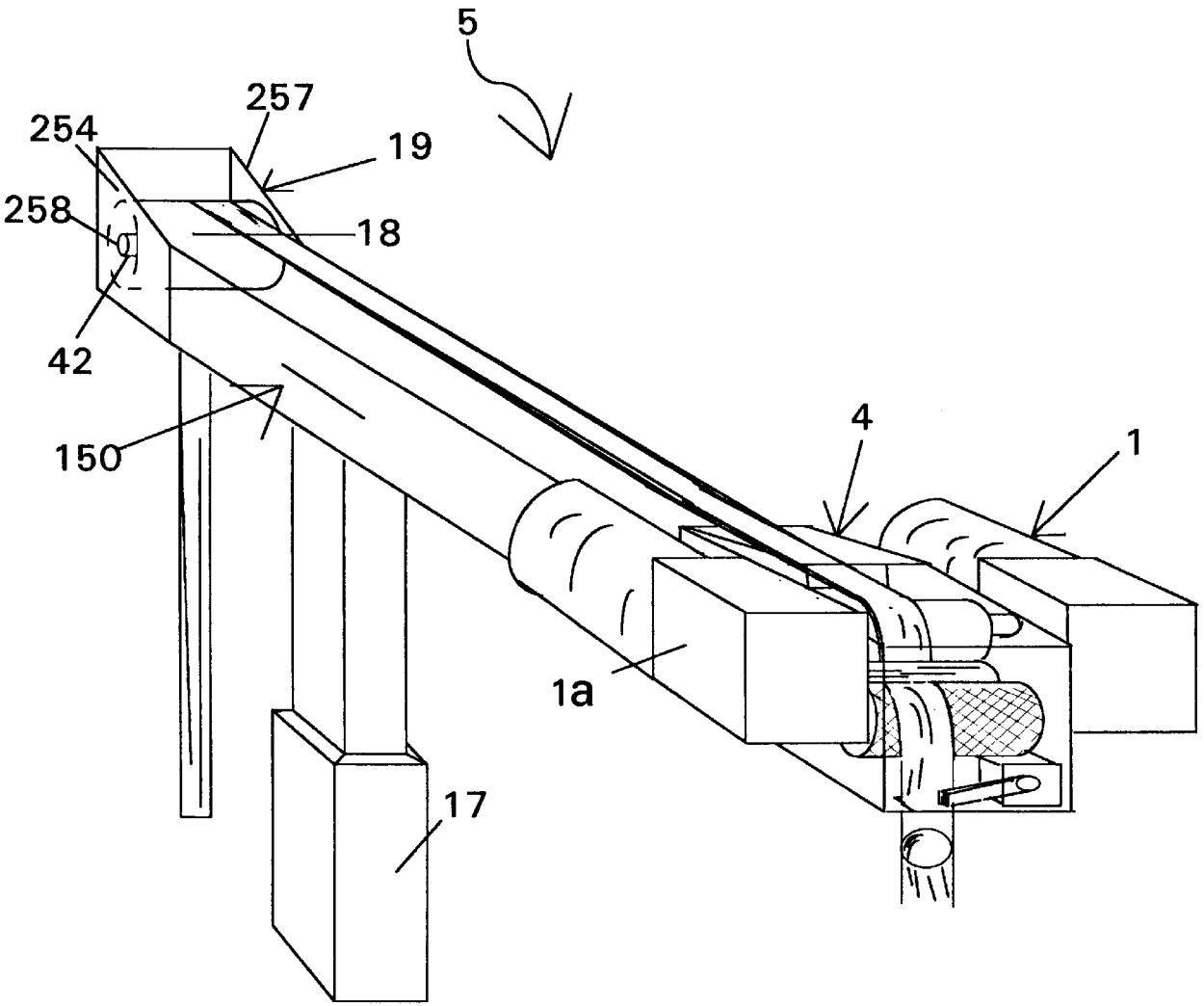
FIG. 9 A perspective view for a vinyl lifting crane including two corresponding drive units for improved torque efficiency.

A gasoline or propane powered combustible engine may be used for facilitating movement for drive rollers of the crane. The transportable crane, hoist, or lift may include two corresponding drive units (See (1) and (la) in FIGS. 9 and 10) for facilitating rotational movement of drive rollers for improvement of torque efficiency. The portable, mobile vinyl lifting crane may be made include aluminum.

A method of using the present vinyl lifting crane or hoist for maintaining advertisement updating or changing an ad sign, billboard roadside sign, or the like, can include the follow steps of: transporting the portable crane to a job site, securing a preferred flat strap, or the like, to an elevated position of a sign structure with a free end of the preferred flat rope contacting the ground. The drive unit of the portable or mobile crane is activated, resulting in rotation of the drive rollers creating traction of the flat strap engaged for facilitating substantially vertical movement of the transportable hoist, up or down the preferred flat strap. Upon arrival at the elevated position of the structure, the transportable hoist can be manually placed into a female member of the structure, jib or trolley for application of hoisting and/or lowering vinyl faces, painted panels, or the like. After proper maintenance of advertisement updating changing of vinyl faces, painted panels, or the like is complete, the transportable crane, hoist, or lift is released from the female member of the structure, jib, or trolley to again engage flat rope for facilitating the substantially vertical movement for descending on the flat rope to the ground level, the transportable crane, hoist or lift can then be transported to the next job site.

Thus it will be appreciated that as a result of the present invention, a highly effective improved mobile jib crane is provided by which the principal objective, among others, is completely fulfilled. It is contemplated, and will be apparent to those skilled in the art from the preceding description and accompanying drawings, that modification and/or changes may be made in the illustrated embodiments without departure from the present invention. Accordingly, it is expressly intended that the foregoing description and accompanying drawings are illustrative of preferred embodiments only and not limiting, and that the true spirit and scope of the present invention be determined by reference to the appended claims.

I claim:

1. A transportable hoist adapted to be removeably coupled to an elevated structure; comprising:

a drive system including a mounting member, a drive motor and a roller connected to said drive motor and driven by said drive motor in a forward direction or reverse direction, said mounting member generally housing said roller;

a battery connected to said drive system to power rotation of said roller, said battery adapted to travel with said drive system, such that, said hoist is self propelled;

an elongate flexible member having a first portion and a second portion, said elongate flexible member engaging said roller to travel said drive system in said forward direction and said reverse direction along said elongate flexible member from said first portion to said second portion; and, wherein said first portion of said elongate flexible member is adapted to connect to said elevated structure and said drive system of said hoist is operable to climb up to said elevated structure by traveling from said second portion to said first portion, and wherein said mounting member of said drive system is adapted to then removeably couple to said elevated structure and said first portion is then releasable from said elevated structure, such that, at least a portion of said first portion is on one side of said roller and at least a portion of said second portion is on a generally opposite side of said roller, and each of said first portion and said second portion are adapted to and may connect to separate load materials for hoisting in ascending and descending directions.

2. The transportable hoist of claim 1, further comprising at least one additional roller.

3. The transportable hoist of claim 1, wherein said elongate flexible member comprises a rope.

4. The transportable hoist of claim 3, wherein said elongate flexible member is a flat rope.

5. The transportable hoist of claim 1, further comprising a guide roller for guiding said elongate flexible member, said guide roller positioned generally to one side of said roller connected to said drive, and a second roller engaging said elongate flexible member positioned generally to an opposite side of said roller connected to said drive motor.

6. The transportable hoist of claim 1, further comprising a first member and a second member, said first member connected to said mounting member of said drive system, said second member being connected generally perpendicular to said first member, and said second member adapted to connect to said structure by a male and female connection.

7. The transportable hoist of claim 6, wherein said first member is a generally horizontal elongate tubing member and said second member is a generally vertical tubing member, said second member adapted to connect to said elevated structure in a generally vertical position, and said first member adapted to cantilever said drive system outward from said first member.

8. The transportable hoist of claim 1, further comprising a sub-frame, a trolley, and a rail, said mounting member of said drive system connected to said sub-frame, said sub-fame connected to said trolley, said trolley connected to said rail, and said rail connected to said elevated structure, such that, said sub-frame and said drive system are adapted to travel along said rail as said trolley travels along said rail.

9. The transportable hoist of claim 1, further comprising a control device adapted to command said drive system in said forward direction and said reverse direction, said control device including at least one manual switch and a remote control switch.

10. A portable hoist, comprising:

a drive system including a drive motor, at least two rollers, and a mounting member, said at least two rollers including at least one drive roller connected to and being driven by said drive motor, said mounting member generally housing said at least two rollers;

a battery connected to said drive system to power rotation of said drive roller, said battery adapted to travel with said drive system, such that, said hoist is self propelled;

a control device for controlling clockwise and counter-clockwise rotational directions of said at least one drive roller;

an elongate flexible member having a first portion and a second portion, said elongate flexible member positioned to engage said at least two rollers where said first portion and said second portion extend separately outward from said mounting member generally housing said at least two rollers; and, wherein said drive system is adapted to travel along and climb said elongate flexible member from said second portion to said first portion when said first portion is connected to an elevated member, and said hoist adapted to lift a load material generally to said elevated member by releasably coupling said drive system to said elevated member and connecting said load material to said second portion and causing said elongate flexible member to travel engagingly along said at least two rollers through said drive system by rotating said at least one drive roller, and where said first portion is capable of being attach to a counterweight while having an ascending or descending a load material attached to said second portion.

11. The hoist of claim 10, wherein said elongate flexible member comprises a rope.

12. The hoist of claim 11, wherein said elongate flexible member is a flat rope.

13. The hoist of claim 10, wherein said battery comprise s a rechargeable battery, and said drive system includes a gear reducer.

14. The hoist of claim 10, further comprising a guide roller positioned generally to one side of said drive roller for guiding said elongate flexible member, and wherein said at least two rollers includes a second roller engaging said elongate flexible member, said second roller positioned generally to an opposite side of said drive roller from said guide roller.

15. The hoist of claim 10, wherein said mounting member connects to said elevated member with a mating male and female connection.

16. The hoist of claim 15, further comprising a sub-frame, said sub-frame including a first member connected to said mounting member and a second member connected generally perpendicular to said first member, said second member adapted to connect to said elevated member via said mating male and female connection, and said elongate flexible member generally extending the length of said first member.

17. A method for lifting a load material up to an elevated member; comprising:

attaching a first portion of an elongate flexible member to said elevated member;

climbing a hoist device up said elongate flexible member from a second portion of said elongate flexible member to said first portion of said elongate flexible member, said hoist device having a drive motor, a battery, and rollers, at least one of said rollers connected to said drive motor, said drive motor powered by said battery and rotating said at least one roller to cause said hoist device to climb said elongate flexible member, said rollers engaging said elongate flexible member, and said elongate flexible member extending generally through said hoist device;

connecting said hoist device to said elevated member in a manner to locate said hoist device adjacent to said elevated member;

connecting said load material to be lifted to said second portion of said elongate flexible member;

traveling said elongate flexible member through said hoist device by rotating said at least one roller, such that, said second portion and said load material connected thereto are drawn generally to said hoist device connected to said elevated member.

18. The method for lifting a load material of claim 17, further comprising the steps of, disconnecting said first portion of said elongate flexible member from said elevated member after said step of connecting said hoist device to said elevated member; and, connecting a counterweight to said first portion of said elongate flexible member.

19. The method for lifting a load material of claim 17, further comprising the steps of;

providing a boom member for said elevated member, and providing a vinyl sign for said load material.

20. The method for lifting a load material of claim 19, further comprising the step of;

providing a billboard structure for said elevated member, said billboard structure including said boom member.

* * * * *